US005992891A

United States Patent [19]

Dyball

[11] Patent Number: 5,992,891

[45] Date of Patent: Nov. 30, 1999

[54] TAMPER RESISTANT IDENTIFICATION CARD

[75] Inventor: Christopher J. Dyball, Half Moon Bay, Calif.

[73] Assignee: Drexler Technology Corporation, Mountain View, Calif.

[21] Appl. No.: 09/054,750

[22] Filed: Apr. 3, 1998

[51] Int. Cl.[6] ..... B42D 15/00

[52] U.S. Cl. ..... 283/89; 283/74; 283/904; 382/116

[58] Field of Search ..... 283/67, 70, 72, 283/74, 89, 904; 382/116; 250/271; 235/468

[56] References Cited

U.S. PATENT DOCUMENTS

| | | | |
|---|---|---|---|
| 3,640,009 | 2/1972 | Komiyama | 283/89 X |
| 4,881,217 | 11/1989 | Ohki | 283/89 X |
| 5,346,258 | 9/1994 | Behm et al. | 283/102 |
| 5,401,960 | 3/1995 | Fisum et al. | 283/89 X |
| 5,403,039 | 4/1995 | Borowski, Jr. et al. | 283/87 |
| 5,862,247 | 1/1999 | Fisum et al. | 283/89 X |

*Primary Examiner*—Willmon Fridie, Jr.
*Attorney, Agent, or Firm*—Thomas Schneck

[57] ABSTRACT

A base layer of an information storage card is coated with a first coating layer that will glow a first color under longwave ultraviolet light. A second coating is applied onto the first coating. This second coating will glow a second color under ultraviolet light. This second coating can then be printed on using standard printing techniques. An attempt to alter the card by removing the printing will damage the first and second coating in a nonuniform manner. This damage will be seen under longwave ultraviolet light, even if the card has been reprinted.

13 Claims, 1 Drawing Sheet

TAMPER RESISTANT IDENTIFICATION CARD

TECHNICAL FIELD

The invention relates to data cards and, more particularly, to identification cards having a security feature.

BACKGROUND ART

Most identification cards now being made are printed by dye diffusion, thermal transfer (D2T2) printers on vinyl or polyester cards. One problem with these cards has been the relatively simple ability to tamper with the printing on the card. It is a fairly simple procedure to remove the printed images and overlays by abrasion of the surface of the card. The card can then be reprinted with a new polymer layer using a D2T2 printer. It is exceedingly difficult to detect these alterations.

Color has been used as a security feature to prevent counterfeiting or tampering with various media. For example, U.S. Pat. No. 5,346,258 teaches use of colored "confusion patterns" above and below play indicia on a lottery ticket. Tampering with the ticket damages the confusion pattern.

In U.S. Pat. No. 5,403,039 Borowski, Jr. et al. teach a thermochromic layer over printing on a lottery ticket or the like. A user can observe the presence or absence of a reversible color change in the thermochromic layer. Tampering with the card affects the thermochromic layer which would be visible when a color reversal is attempted.

Presently, no technology adequately addresses the problems with tampering of identification cards.

A primary object of the invention is to develop an identification card that will be highly resistant to tampering. It is a further object of the invention that the detection of any tampering done to the card be detectable in a manner that is both simple and rapid. It is a final object of the invention to be able to effect this detection even if the printing on the surface of the card has been removed and a new layer of printed material added onto the surface of the card.

SUMMARY OF THE INVENTION

The present invention is directed to information storage cards and teaches a card with improved security. The card has a base layer comprised of a polymeric material. One possible polymeric material for the base is polycarbonate. Bonded to the base layer of the card is a first coating layer. This first coating layer is a thin coating of clear polymeric material. This coating will glow at a given wavelength when exposed to longwave ultraviolet light. Bonded onto this first coating is a second coating layer. This second coating layer is another thin coating of a clear, polymeric material. This coating will glow at a given wavelength when exposed to longwave ultraviolet light. The wavelength that the first coating will glow at differs from the wavelength the second coating will glow at.

The second layer can be printed on by a dye diffusion/thermal transfer (D2T2) printer. In one embodiment of the invention, a clear protective outer layer can be mounted over the printing.

An uncompromised card of such construction will glow uniformly with a color that depends on the ultraviolet characteristics of the material of the first and second coatings. However, any attempt to remove the printing by abrasion will also remove some of the second and third layers. The resulting card will have a mottled pattern when exposed to longwave UV light.

It is also possible to have a first and second dye that contain two colors that are visible in the ambient spectrum. Any attempt to alter the face of the card would be apparent on the visible surface of the card because some of the color layers would have been removed by the attempt to deface the card.

BEST MODE FOR CARRYING OUT THE INVENTION

Figure 1:
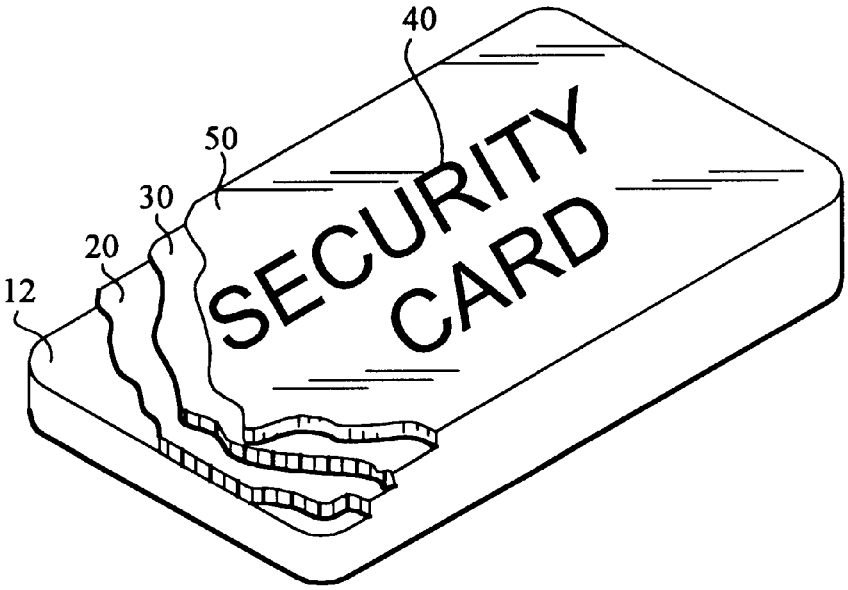
FIG. 1 is a top view of the card with cut away sections revealing the layers composing the card.

With reference to FIG. 1, the first layer is the base layer 12. This layer can be composed of various materials including metal, vinyl, polyester, or other polymers. In the preferred embodiment, a polycarbonate base layer is used, which should be white or light in color. Although polycarbonate has poor dye retention, it is a superior polymer for high wear applications, resulting in a very durable card. Surface coatings can be applied to provide a better substrate for dye adhesion.

Applied to the top of base 12 is first coating layer 20. This coating is a clear layer of transparent polymeric material that is applied in a coating that is about 10 microns thick. The material can be air curable, UV curable or curable by addition of a catalyst or simply cured by evaporation of a solvent carrier. To enable verification of a uniform coating, a dye is included in the coating that glows at a determined wavelength when exposed to longwave ultraviolet light (blacklight). In the preferred embodiment, the first coating is UV curable and will glow red. This will allow rapid production.

Applied on top of first coating layer 20 is second coating layer 30. This coating layer, like the first coating layer, is a transparent curable material applied to be about 10 microns thick. This coating is cured in the same manner as the first coating. A second dye is added that will glow at a second determined wavelength when exposed to blacklight. In the preferred embodiment, this second coating will glow blue. When second coating 30 is applied on top of first coating 20 the card, when exposed to blacklight, will have an overall blue glow.

Coating layer 30 can then be printed with printing 40. The coating acts as a receptor for the printing dyes. The dye diffusion/thermal transfer printers are used to create the image on the coating layer.

On top of the second coating layer 30 with printing 40 is applied clear protective coating 50. This coating is made of a durable polymer that will provide protection to the surface of the card.

Figure 2:
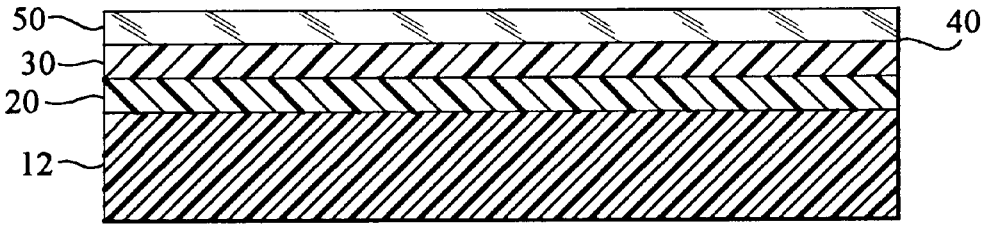
FIG. 2 is a side perspective of the card showing the base layer and the upper coating layers.

FIG. 2 shows an exploded view of the card. Top protective coating 50 is adhered to second coating 30 marked by printing 40. Second coating 30 adheres to first coating 20 that adheres to base 12.

If this card is placed under a UV light, the card will have a blue glow. This glow can be observed even through the printing on the card. Any attempt to remove the printing by abrasion or chemical solvents would also remove some of the dye impregnated coatings. When viewed under blacklight, the card would have a mottled appearance, with patches of blue, magenta, and red. If a new layer of printing was applied by dye diffusion/thermal transfer printer, the card would appear valid under normal light, but under blacklight the attempt to tamper with the data card would be immediately apparent by the mottled colors.

To produce the card, different manufacturing methods are possible. A receptive layer for a D2T2 printing was formulated as follows:

98.8 g of HG series clear vinyl ink (Coates Screen, Ontario, Calif.) was combined with 0.2 g of C206 Invisible blue dye (Shannon Luminescent Materials, Santa Ana, Calif.).

The above formulation was coated through a 320 mesh silk screen onto the white polycarbonate back of an optical card. The applied coating was allowed to dry at room temperature overnight. The dried coating was clear and colorless with a thickness of 7 microns. The coating exhibited a blue glow when viewed under longwave UV light.

A second coating was formulated as follows:

98.8 g of HG series clear vinyl ink (Coates screen, Ontario, Calif.) was combined with 0.2 g of C638 Invisible red dye (Shannon Luminescent Materials, Santa Ana, Calif.).

The second coating was applied through a 320 mesh silk screen on top of the first coating and allowed to dry overnight. The second coating was also clear and colorless with a thickness of 7 microns. The coating exhibited a uniform red glow when viewed under longwave UV light.

The card with dual coatings is printed, on its coated surface with a colored identification image and text using a dye diffusion printer (ImageCard II plus made by DataCard, Minneapolis, Minn.). Four panels consisting of yellow, magenta, and cyan dye diffusion panels plus thermal transfer black are used. The printed card has good image saturation and contrast.

The image printed on the data card of the present invention can readily be removed using fine grain sandpaper, leaving a smooth surface on the card. However when the sanded card is examined under longwave UV light, the red glow is no longer uniform, the card had a mottled appearance having areas of red, magenta and blue.

The sanded card can be reprinted with a new image using a data card printer. However, when the printed card is viewed under longwave UV light, the mottled appearance of the receptor layer is still apparent.

A second method of producing the card is detailed below. A receptive layer for a D2T2 printing is formulated as follows:

98.8 g of MSK-049 Clear coating (Norcote International, Crawfordsville, Ind.) is added to 0.2 g of C638 Invisible red dye (Shannon Luminescent Materials, Santa Ana, Calif.).

The above formulation is coated through a 400 mesh silk screen onto the white polycarbonate back of an optical card. The applied coating is dried by one pass under a 200 W/inch mercury lamp at 10 feet/minute. The dried coating is clear and colorless with a thickness of 10 microns. The coating exhibited a red glow when viewed under longwave UV light.

A second coating is formulated as follows:

98.8 g of HG series clear vinyl ink (Coates Screen, Ontario, Calif.) is combined with C206 Invisible blue dye (Shannon Luminescent Materials, Santa Ana, Calif.).

The second coating is applied through a 400 mesh silk screen on top of the first coating and dried by one pass under a 200 W/inch mercury lamp at 10 feet/minute. The second coating is also clear and colorless with a thickness of 7 microns. The coating exhibits a uniform blue glow when viewed under longwave UV light.

The card with dual coatings is printed on its colored surface with a colored identification image and text using a dye diffusion printer (ImageCard II plus made by DataCard, Minneapolis, Minn.). A four panel ribbon yellow, magenta, and cyan dye diffusion panels plus thermal transfer black is used. A second clear overcoat ribbon is used to provide a clear protective layer over the print. The printed card has good image saturation and contrast.

Again, the image printed a data card printer can readily be removed using fine grain sandpaper, leaving a smooth surface on the card. However, when the sanded card is examined under longwave UV light, the blue glow is no longer uniform, the card has a mottled appearance having areas of red, magenta and blue.

The sanded card can be reprinted with a new image using a data card printer. However, when the printed card is viewed under longwave UV light, the mottled appearance of the receptor layer will still be apparent.

I claim:

1. A tamper resistant information storage card comprising:

a polymeric base layer;

a first coating disposed atop and bonded to said base layer, said first coating containing a first dye, said first dye having the property that said first dye will glow at a first wavelength when exposed to longwave UV light; and a second coating disposed atop and bonded to said first coating, said coating being composed of a printable polymer with said second coating containing a second dye, said second dye having the property that said dye will glow at a second wavelength when exposed to longwave UV light.

2. The card of claim 1 further comprising:

a pattern of indicia dye printed from a dye diffusion/thermal transfer printer printed onto said second coating.

3. The card of claim 1 wherein said base is made of polycarbonate.

4. The card of claim 1 wherein said first wavelength would be seen to be blue and the second wavelength would be seen to be red.

5. The card of claim 1 wherein said first and second coatings are made from a UV curable polymer.

6. The card of claim 1 wherein said first and second coatings are made of an air curable polymer.

7. The card of claim 1 further comprising:

a clear protective polymer layer applied onto and bonded to said second coating layer.

8. The card of claim 3 further comprising:

a third coating disposed atop and bonded to said base layer on the opposite side of the card as said first coating, said third coating containing said first dye; and a fourth coating disposed atop and bonded to said third coating, said fourth coating being composed of a printable polymer with said fourth coating containing said second dye.

9. The card of claim 8 wherein said first wavelength would be seen to be red and the second wavelength would be seen to be blue.

10. The card of claim 8 wherein said first, second, third and fourth coatings are made from a UV curable polymer.

11. The card of claim 8 wherein said first, second, third and fourth coatings are made of an air curable polymer.

12. The card of claim 8 further comprising:

a clear protective polymer layer applied onto and bonded to said second coating layer and a second clear protective polymer layer applied onto and bonded to said fourth coating layer.

13. A method of making a tamper resistant information storage card comprising:

applying a polymeric base layer on a substrate applying a first coating of a solution of printable polymer in a solvent having a first dye therein, disposed atop and bonded to said base layer, followed by evaporation of the solvent, said first dye having the property that said first dye will glow at a first wavelength when exposed to longwave UV light; and applying a second coating of a solution of printable polymer in a solvent having a second dye therein, disposed atop and bonded to said first coating, followed by evaporation of the solvent, said second dye having the property that said dye will glow at a second wavelength when exposed to longwave UV light.

* * * * *